United States Patent [19]

Ristvedt et al.

[11] 4,444,212

[45] * Apr. 24, 1984

[54] COIN HANDLING MACHINE

[75] Inventors: Victor G. Ristvedt; Roy B. Johnson, both of Manchester, Tenn.

[73] Assignee: Ristvedt-Johnson, Inc., Manchester, Tenn.

[ * ] Notice: The portion of the term of this patent subsequent to Jul. 4, 1995 has been disclaimed.

[21] Appl. No.: 207,963

[22] Filed: Nov. 18, 1980

Related U.S. Application Data

[63] Continuation-in-part of Ser. No. 921,063, Jun. 30, 1978, Pat. No. 4,234,003, which is a continuation of Ser. No. 735,060, Oct. 22, 1976, Pat. No. 4,098,280.

[51] Int. Cl.[3] ..... G07D 3/00

[52] U.S. Cl. ..... 133/3 A; 133/8 R

[58] Field of Search ..... 133/1 R, 3 R, 3 A, 8 R, 133/8 C; 271/167–169; 198/392; 209/915, 917

[56] References Cited

U.S. PATENT DOCUMENTS 3,837,139 9/1974 Roseberg ..... 133/8 R 4,086,928 5/1978 Ristvedt et al. ..... 133/3 A 4,234,003 11/1980 Ristvedt et al. ..... 133/3 A

FOREIGN PATENT DOCUMENTS 52-74396 6/1977 Japan ..... 133/3 A

*Primary Examiner*—H. Grant Skaggs

*Attorney, Agent, or Firm*—C. A. Phillips

[57] ABSTRACT

A coin sorting machine in which coins are fed onto the center of a rotating disc having a flexible surface. An annular guide plate is positioned over the disc, being open in the center for receiving coins, and extending outward to the peripheral edge of the disc. The underside of the guide plate is formed with a peripheral stop extending around approximately half of the disc, and a series of discrete radial guides extend over portions of the other half of the disc. The first of the series of guides would have an outer edge differing in radius from the peripheral stop by the diameter of the smallest coin to be sorted, and each succeeding guide would have a progressively smaller radiused outside edge defined by the difference between coins to be sorted by succeeding guides.

10 Claims, 22 Drawing Figures

COUNTER
COUNTER 349
372

396
394
382

350
360
302
372
378
410
375
358
412
406
408
422
420
414
416
418
426
12
424
358
428
429
430

43
432
433
436
434
380
362
382
390
392
388
308
374
386
387
384
14
366
360a
352
359
319
370
404

COIN HANDLING MACHINE

This application is a continuation-in-part of patent application Ser. No. 921,063, filed June 30, 1978, entitled "Coin Handling Machine", U.S. Pat. No. 4,234,003, which is a continuation of application Ser. No. 735,060, filed Oct. 22, 1976, U.S. Pat. No. 4,098,280.

BACKGROUND OF THE INVENTION

1. Field of the Invention

This invention relates to coin handling machines employing a rotating disc for sorting and verifying coins.

This application is a continuation-in-part of patent application Ser. No. 921,063, filed June 30, 1978, entitled "Coin Handling Machine".

2. General Description of the Prior Art

The denominational sorting of coins is a substantial chore for handlers of coins, particularly banks and vending machine companies. In view of the tremendous volume of coins which are sorted, it is quite obvious that for a machine to adequately meet their needs, the machine must be capable of highspeed operation. Further, it must be tolerant to a variation of coin thicknesses and be relatively jam-proof. With respect to speed, sorting speeds of known devices are in the range of 1,500 to 2,500, and at this time, the applicants have been advised that much higher speeds, ideally in the range of 6,000 to 8,000, are much needed. Ideally, coin verifiers, devices for verifying the number of coins in a container, should operate at speeds substantially higher than possible with existing devices, which it is believed operate in a range up to about 10,000 coins per minute.

An object of the present invention is to provide a coin sorter of simpler construction than previously existed and to provide a coin verifier with much increased speed, speed in the range upward to 20,000 coins per minute.

DISCLOSURE OF THE INVENTION

In accordance with this invention, a guide plate is positioned over a rotating disc having a flexible, generally flat, surface, the spacing between the two being generally that of the thickest coin to be handled. A series of lands extend down to the surface of the disc, forming a series of guide means to control coin movement. A first guide means includes an annular-shaped land or guide having an inward facing shoulder extending part way around the disc and inboard of the periphery of the disc, it functioning to receive coins moved by centrifugal force from the center of the disc outward and to initially form the coins in a generally circular single file. A second guide means employs a peripheral limit and stabilizing guide, and this guide means extends around a part of the disc which does not circumferentially border the first guide means. The stabilizing effect is achieved by a guide being tapered downward with increasing radial dimension to thus form an interfacing edge, whereby coins are wedged between this guide and the flexible surface of the disc as they are rotated. A third guide means consists of a passageway between the first and second guide means, and this passageway is generally along a line normal to a radial line. In the case of a coin sorter, coin release guide means are included, which have a series of coin release guides which commence at an operating end of the second guide means, each successive coin release guide having an outer release radius progressively smaller than the radius of the preceding guide by the difference in diameter of coins to be released by successive guides. Where they appear, leading edges of the guide means are tapered so that a coin striking a leading edge will not be stopped by the leading edge, but will be depressed into the flexible surface and captured, and the coin will be caused to rotate at a fixed radial distance until it is no longer depressed by that guide means, whereby a captured coin will either be released by a coin release or rotated back into the center region of the disc, enabling it to be repositioned on an inner facing shoulder of the first guide means, and thereafter positioned in a single file.

DETAILED DESCRIPTION OF THE DRAWINGS

Figures 1, 2, 3, 4:
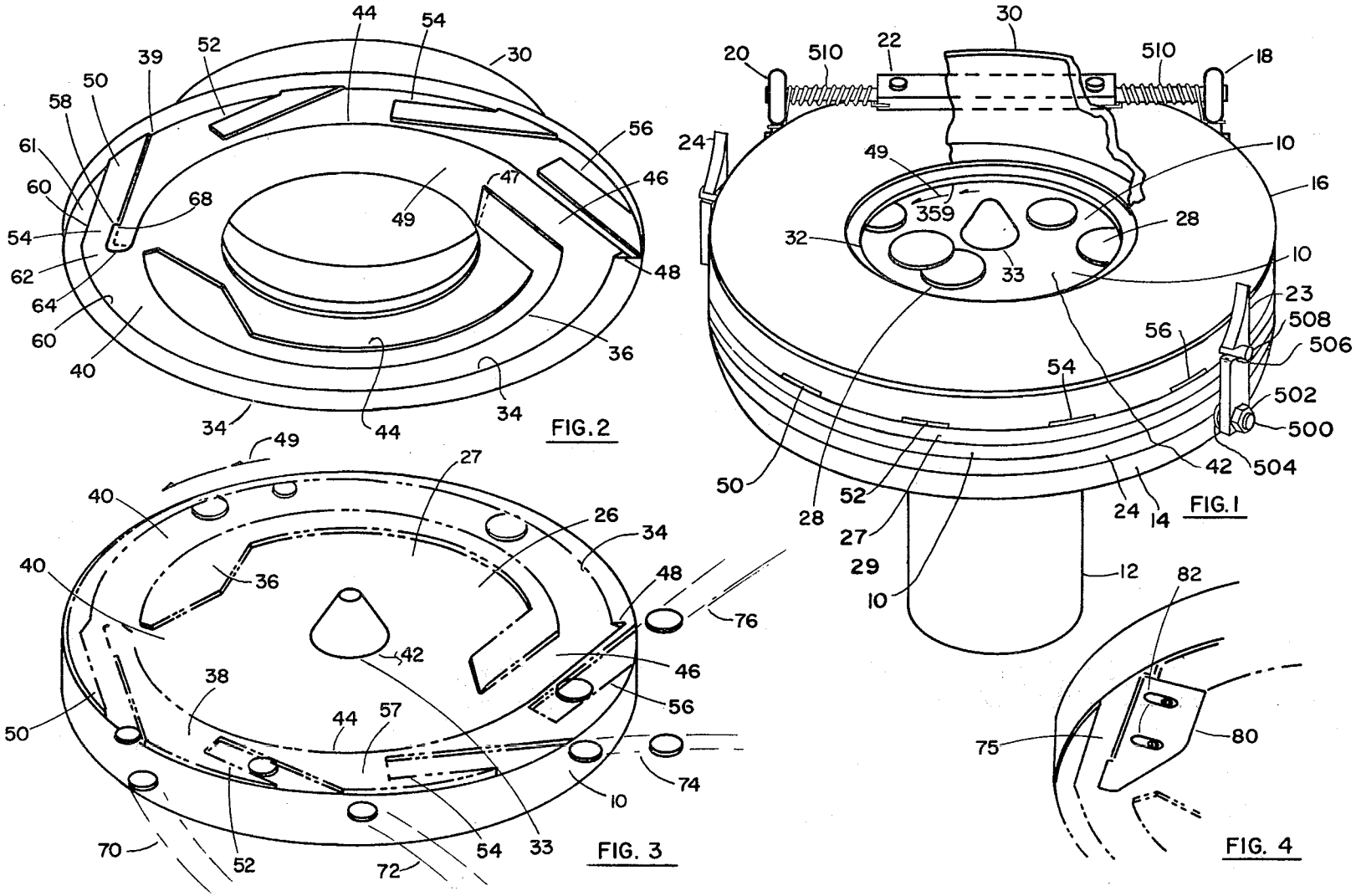
FIG. 1 is a pictorial view of an embodiment of this invention.
FIG. 2 is a pictorial view of a top guide plate for controlling the movement of coins as contemplated by this invention.
FIG. 3 is a pictorial view of the rotating disc platform for coins illustrating in phantom lines the position of coin guides on the underside of the guide plate shown in FIG. 2.
FIG. 4 is a broken pictorial view illustrating an adjustable coin release as contemplated by this invention.
Figure 22:
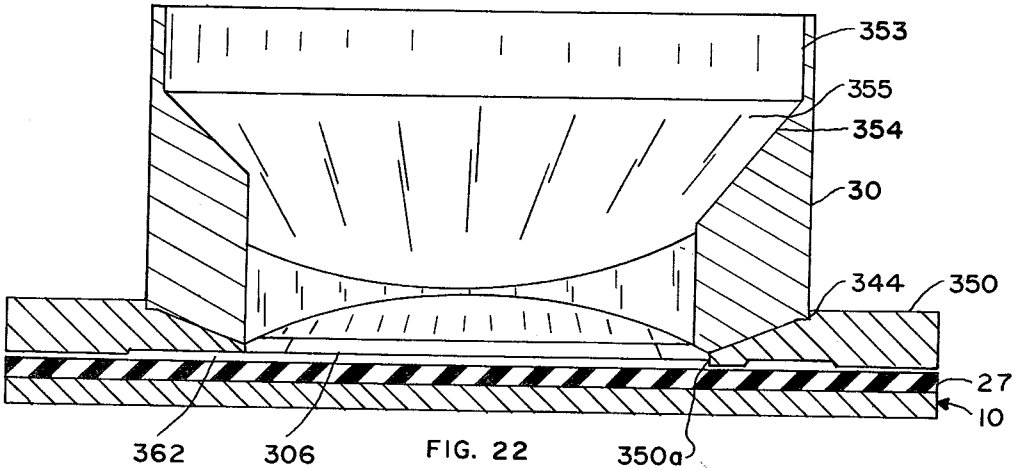
FIG. 22 is a sectional view taken along line 22—22 of FIG. 20.
Figure 16:
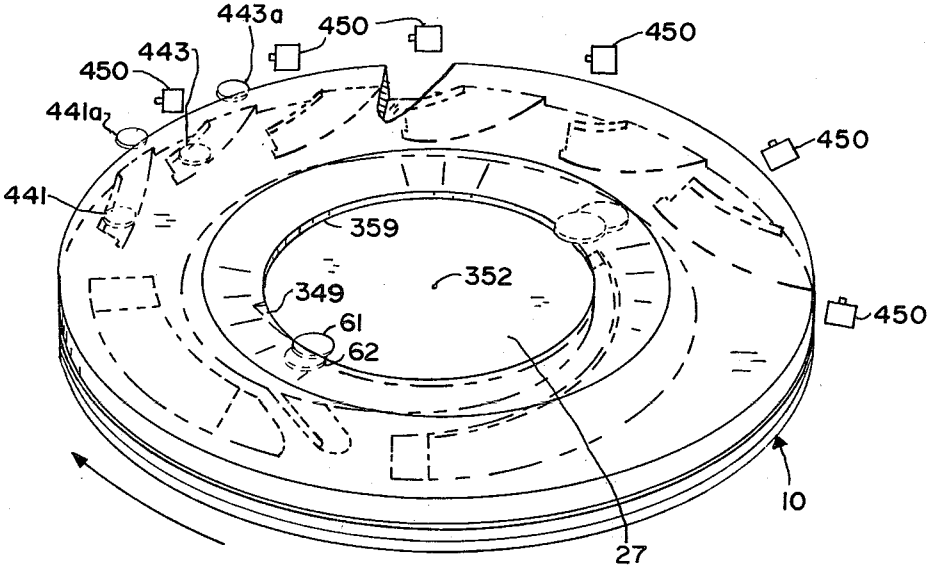
FIG. 16 is a pictorial view of the rotating disc platform for coins, illustrating in phantom lines the position of coin guides shown in FIG. 11.
Figure 21:
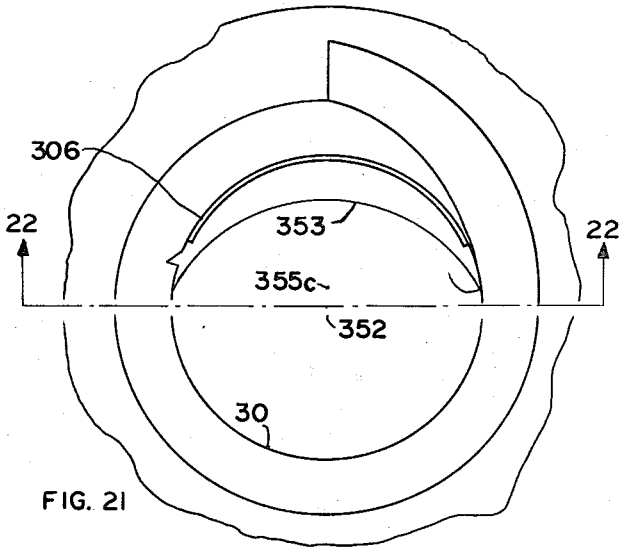
FIG. 21 is a bottom plan view of a portion of a guide plate, showing a hopper as seen from such a view.
Figure 20:
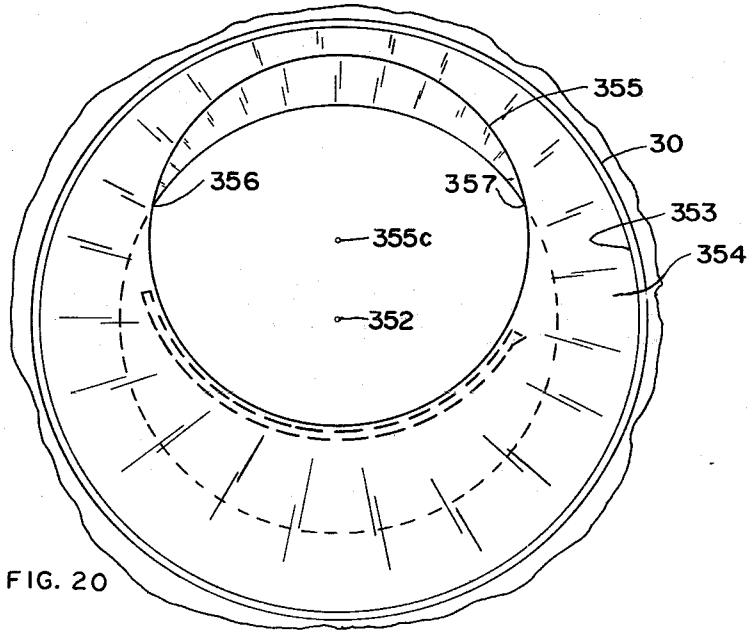
FIG. 20 is a top plan view of a hopper as installed with a portion of the guide plate on which it is mounted broken away.
Figure 18:
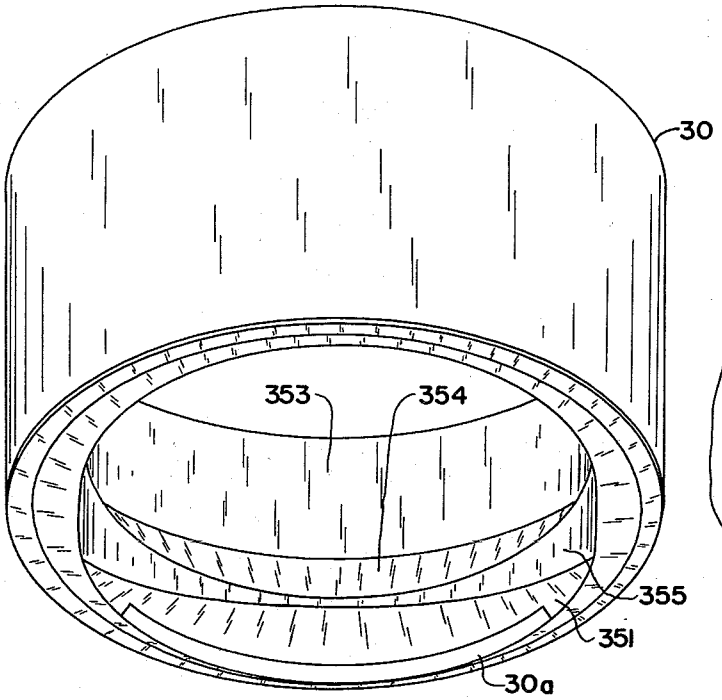
FIG. 18 is a pictorial view of a hopper as seen from a lower, front, position in terms of the orientation of the sorter shown in FIG. 1.
Figure 17:
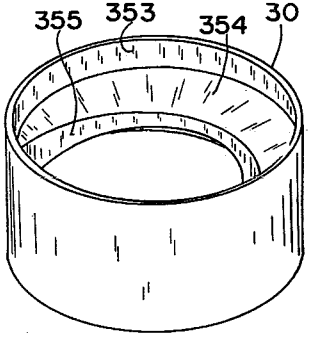
FIG. 17 is a pictorial view of a coin hopper as seen from above and to the rear of a hopper as it would be employed with respect to the view of the sorter as seen in FIG. 1.

Referring to FIG. 1, a rotating disc 10, of approximately 8 to 20 inches in diameter, is driven by motor 12, both being supported by a 4-point mounting assembly, being pivotally mounted on base 14 through pivot mounts or supports 18 and 20 by means of mounting bar 22 and by identical latches 23 and 24. Each of latches 23 and 24 are pivotally mounted on base 14 by a pin 500. Nut 502 on pin 500 provides a supporting collar for a latch, which latch is spaced from base 14 by spacer 504. When latched (as shown), a receptacle 506 of a latch (e.g., 23) fits closely over and under pin 508, which extends outward from guide plate 16. Guide plate 16 may be opened back by moving backward latching latches 23 and 24, whereby guide plate 16 would pivot about supports 18 and 20 and movable to a vertical position, exposing the top surface of disc 10. A pair of springs 510, coupled between guide plate 16 and supports 18 and 20, tend to bias the guide plate upward, and thus there is provided protection against the guide plate coming down on someone's fingers when raised. Disc 10 has an overlay of a pliable resilient surface 26 provided by an elastomer pad 27, the pad having a typical thickness of from 0.2 to 0.4 inch. This pad, supported on plate 29 of disc 10, typically would have a firmness of 5 to 10 in the firmness scale employed for sponge material. Coins 28 are supplied to the sorter through a hopper 30 (FIG. 1) as illustrated in FIGS. 16 and 17, the hopper being supported in a support groove 31 around an opening 32 in guide plate 16 (FIGS. 1 and 22).

Referring to FIGS. 2 and 3, it will be noted that the underside of guide plate 16, which is generally flat, has three downwardly extending guides, being peripheral limit guide 34, single file guide 36, and coin release guide 38. Guide plate 16 is positioned with respect to rotating disc 10 such that these guides extend down to the top flexible surface 26 of disc 10, leaving the other regions 40 with a clearance in which coins are free to move unimpeded by the guides. Thus, the guide surfaces generally have a thickness of approximately 0.08 to 0.085 inch, corresponding generally to the thickest coin to be sorted. Guide 36 functions to route coins from the central region 42 of disc 10 radially outward over a limited peripheral region of approximately 180°, where they would be stopped by an inner wall 44 of guide 38, and then as they are rotated, they would pass through a single file passageway 46 to form a single file on peripheral limit guide 34, this guide having a tapered edge 48 which effects a wedge action on the coins, stabilizing their movement against radial bounce, causing the coins to be moved circumferentially in a spaced format as shown about disc 10. Coins reaching passageway 46 which are not against inner wall 44, and thus not in a single file, are captured by tapered edge 47 (similar to that shown in FIG. 10), pressed into pad 27, and rotated back into the center of disc 10. Double layers of coins are prevented in the passageways betwen guides by maintaining a clearance (0.08 to 0.085 inch) between the flexible surface of disc 10 and upper surface 49 of plate 16 of less than the double thickness of the thinnest coins to be sorted, in the present case, dimes, which have a thickness of about 0.05 inch each. The coins continue in the circular direction indicated by arrow 49 until they reach coin release guide 38. As shown, coin release guide 38 contains four coin release slots, coin release slot 50 for dimes, coin release slot 52 for pennies, coin release slot 54 for nickels, and coin release slot 56 for quarters. The slots or recesses comprise discrete or selected recessed areas in plate 16 and are of a width equal to or slightly larger than the diameter of such coins. As shown, the coins encounter progressively larger slots as they are rotated by disc 10 counterclockwise under coin release guide 38 by being compressed between the lower face 57 of guide 38 and the flexible surface of disc 10 and are released.

Assume first that a dime is the first coin in line approaching coin release guide 38, it having its outer edge against the inner edge 60 of turned-in guide extension 61 of guide 34. The coin thus engages with its inner edge the outer leading edge 62 of guide 38, which edge is tapered upward to gradually depress a coin and seize it. Thus, from points 64 to 68, the coin is wedged in a stabilized radial position until it reaches the full dime width of dime slot 50, where it is freed of vertical restraint and is thus free to follow the outwardly extending path of slot 50, which extends essentially normal to a radial line and thus to the edge of disc 10, enabling a dime to be ejected at a peripheral position or path 70, at which a coin sorting bag or outer receptacle (not shown) would be positioned.

Assume next that a larger coin, say, a penny, arrives at and strikes leading edge 62 of guide 38. Such coin will be captured by the outwardly extending edge of guide 38 between points 64 and 68 and continue to be captured by virtue of the fact that the inner edge of the coin will be forced inward of the inner edge of dime slot 50 by edge 60, and thus be wedged between the top surface of disc 10 and guide 38. This will cause the coin to be moved in a rotary pattern rather than to be free to move outward. The rotary movement of the coin continues until it strikes penny slot 52, and since slot 52 is of a width to accommodate a penny, a penny will be released from vertical pressure, and, by virtue of its momentum, it will be hurled outward in slot 52 along a path 72 where it would be intercepted by a penny sorting bag or receptacle (not shown). In a similar manner, larger coins, nickels and quarters, would be captured and sorted by slots 54 and 56, respectively, being intercepted by bags at path positions 74 and 76, respectively.

FIG. 4 illustrates a coin release slot 78 formed by an adjustable guide member 80, which is movable in adjustment slots 82 to enable a coin release slot to be formed of any desired width. Such an adjustable slot assembly may be positioned as the first, intermediate, or last slot in a series, depending upon a desired range of adjustment. Similarly, it may be the only slot in an assembly where, for example, the sorter is to be employed as a coin verifier wherein it is only necessary that coins be routed in a single file from the device, enabling them to be hurled into space in a spaced single file where they can readily be counted by optical, electrical, or other conventional counting means.

Figures 5, 6, 7, 8, 9, 10:
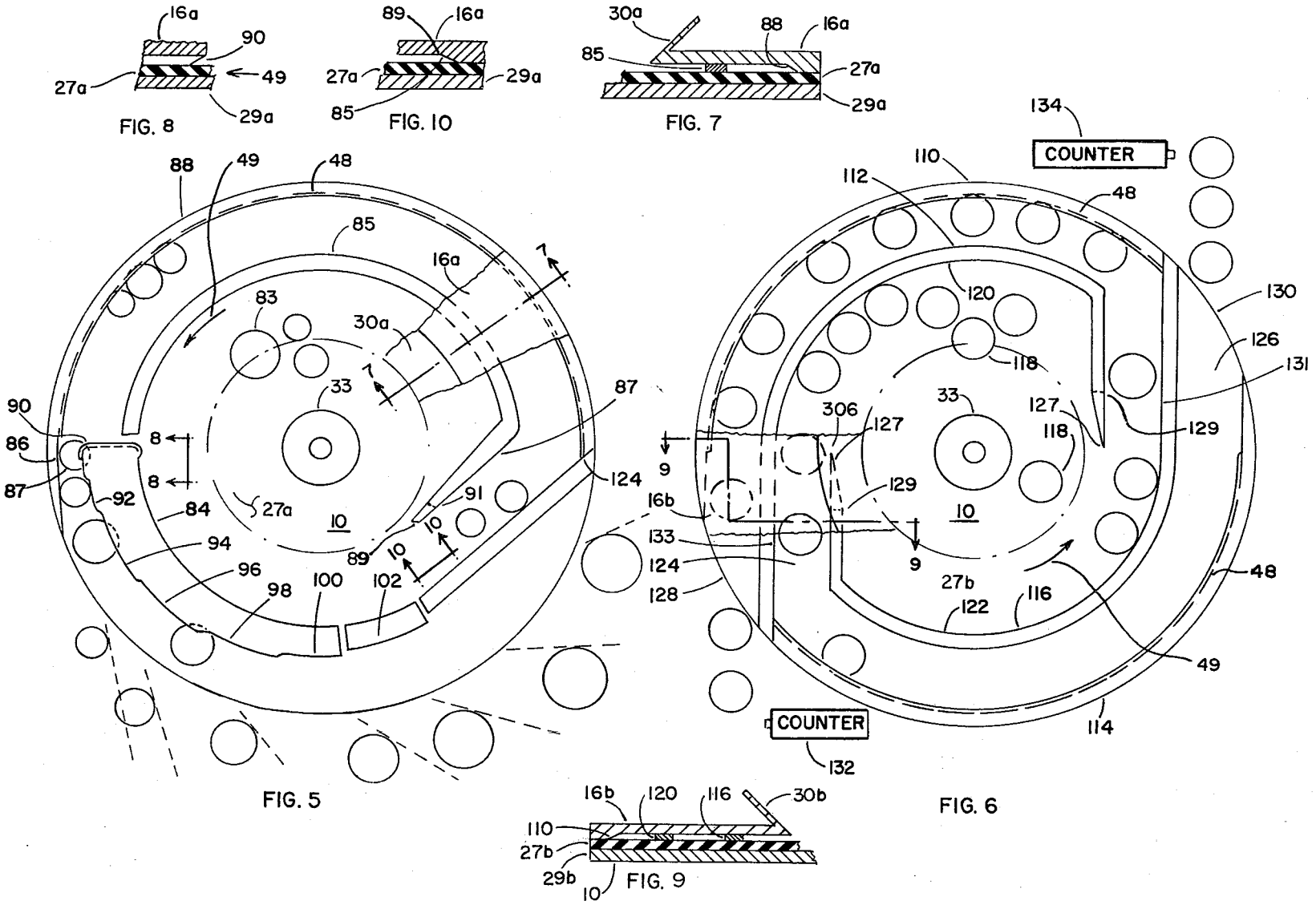
FIG. 5 is a plan view of a modification of this invention illustrated by a modified form of guide superimposed over a rotating disc.
FIG. 6 is a plan view of a further modification of this invention, particularly useful for coin count verifying illustrated by superimposing another form of guide assembly over a rotating disc.
FIG. 7 is a sectional view taken along line 7—7 of FIG. 5.
FIG. 8 is a sectional view taken along line 8—8 of FIG. 5.
FIG. 9 is a sectional view taken along line 9—9 of FIG. 5.
FIG. 10 is a sectional view taken along line 10—10 of FIG. 5.

FIG. 5 illustrates a further and simplified form of construction of the invention, showing the guide plates as they would be seen if viewing them vertically downward and without the flat supporting guide plate structure, except as briefly shown in broken form in sectional views thereof in FIGS. 7 and 8. Generally, circular guide member 85, shown in FIG. 7, blocks the exit of coins from the center of disc 10 except through a single file passageway 87, leading edge 89 thereof being tapered, as shown in FIG. 10, to capture any coins tending to be stopped by the leading edge of guide 85, causing any such coins to be rotated back into the center of disc 10. The basic change illustrated by this embodiment of the invention is in the form of the coin release guide, illustrated by coin release guide 84. The leading edge 90 of this guide is illustrated in FIG. 8 as a part of top plate 16*a* (broken), illustrating that a coin carried in the direction 48*a* on pad 27*a* would be forced down into pad 27*a* and be captured and rotated in an arc having a discrete radius as defined by the captured coin. FIGS. 7 and 8 also illustrate that pad 27*a* is supported on circular plate 29*a*, typically secured in place by conical hub 33.

In contrast to guide 38 shown in FIG. 3, guide 84 of FIG. 5 has only a series of progressively shortest radiused outer edges. Thus, for example, a dime 87 would be captured between outer guide 86, an extension of peripheral stop guide 80, and leading edge region 90 of guide 84 until that coin of coins 83 reaches the indentation 92, at which point a dime would be freed from restraint and would be hurled outward in the same manner as described above.

Coins larger than a dime would be initially secured in the same manner and would continue rotation in a circular pattern on disc 10 until released by one of the coin release indentations 94, 96, 98, 100, 102, or 104, each being of progressively shorter radius to progressively release larger coins as they travel counterclockwise. If desired, the device may be made to operate clockwise by reversing the arrangement of the guides. The actual number and outer edge radius of the releases are dependent upon the number and diameter of coins to be released. It is only necessary that the dimension between guide edge 90 and guide edge 86 be smaller than the smallest coin to be released in order to initially capture a coin. Coin release 102 is shown as being discrete from coin release guide 84 as an example of a removable or an interchangeable guide to accommodate a selected coin size greater than the size released by release edge 100. Coin release 104 also serves as an extension of guide 84 to prevent coins from escaping from the center of the coin sorter except by the release route described.

Guide 106 guides coins from the center of disc 10 onto the inner edge of guide 88 to form a single file as in the case of guide 36 of the embodiment shown in FIGS. 2 and 3.

FIG. 6 illustrates a coin verifier, a device which functions to arrange coins in a single file and then count them, the purpose being to determine the accuracy of a count of coins in some container. A device of the type illustrated in FIG. 6 would have the same drive system, rotating disc, top supporting plate, and hopper as shown in FIG. 1. This general arrangement is partially illustrated in the sectional view shown in FIG. 9 illustrating the relationship of hopper 30*b*, top plate 16*b*, and pad 26*b* on steel rotating plate 29*b* of disc 10. The guide configuration is different, as shown in Figs. 6 and 10. Except where broken for purposes of the sectional view, FIG. 6 shows only the downward extensions of plate 16*b* which form, in this case, peripheral limit guides 110 and 114, which are identical, and inner guides 112 and 116, also being identical. It would differ in that the guides which extend down from the top, flat, supporting guide plate 160 would be configured as shown in FIG. 6 wherein only the relief surface of the top supporting plate as shown in the form of guides 110, 112, 114, and 116 would be employed. Thus, as shown, coins 118 placed on disc 10 through hopper 30 (FIG. 1) would radiate outward against inner edges 120 and 122 of guides 110 and 116, and then would be routed through passageways 124 and 126 to form a single file which is edged against flexible pad 27*b* by guides 110 and 114, having a tapered configuration as shown in FIG. 9. This prevents bounce and increases the speed of operation. Thus, coins would be rotated in a single file until they come to exits 128 and 130, where they would be hurled along a line outward to be intercepted or passed by counters 132 and 134, which would count them. Identical leading edges 127 of guides 112 and 116 are tapered back to point 129 similar to the tapering of guide 85, as shown in FIG. 10, so that any tendency of two coins wedged together between guides at the entrance to passageways 131 or 133 is prevented by the inner of such coins being captured under this tapered edge of the guide and the coin rotated back into the center region of the disc. A counter may be of a type employing light, radiation, magnetic, or another form of conventional sensing to effect counting. After leaving counters 130 and 132, coins would be fed to coin bags (not shown).

While the coin verifying device shown in FIG. 6 illustrates two verifying paths, a single one may be effected by making guides 110 and 114 continuous, omitting, for example, passageway 126 and making guides 116 and 112 circularly continuous and leaving a single exit 128.

It is to noted that in contrast to previous verifiers, the present verifier needs no adjustment to verify different size coins. Further, by making the counters selective insofar as the denomination of coin counted is concerned, a monetary value count of coins passing through the verifier may be achieved, or the detection of "off" denomination coins which were unintentionally mixed may be achieved.

FIGS. 11–16 illustrate an alternate configuration for a guide plate, and FIGS. 17–22 particularly illustrate a coin hopper 30.

Hopper 30 has a round exterior which fits within a circular groove 31 of annular guide plate 350 (FIG. 16) concentric with the center point 352 of rotating disc 10 (FIG. 16). A top inner edge region 353 of the hopper, which is concentric with the center point 352, provides an entrance region for coins. A tapered region 354 extends continuously downwardly and inwardly from the top region. It is interrupted by cylindrical cut region 355 (FIGS. 18, 20 and 22) which is offset, having a center point 355*c*. This cylindrical cut region provides a final exit from the hopper to disc 10, from which the coins migrate under guide plate 350, to be sorted as described above. An underside region 351 (FIGS. 18 and 19) of the offset portion of the exit region is tapered, extending from point 356 to point 357. The tapered region in conjunction with the eccentricity of the offset causes any coins which might tend to stand up on edge as they move around hopper 30 to be flipped over to a normal, flat position on pad 27.

Figures 11, 12, 14:
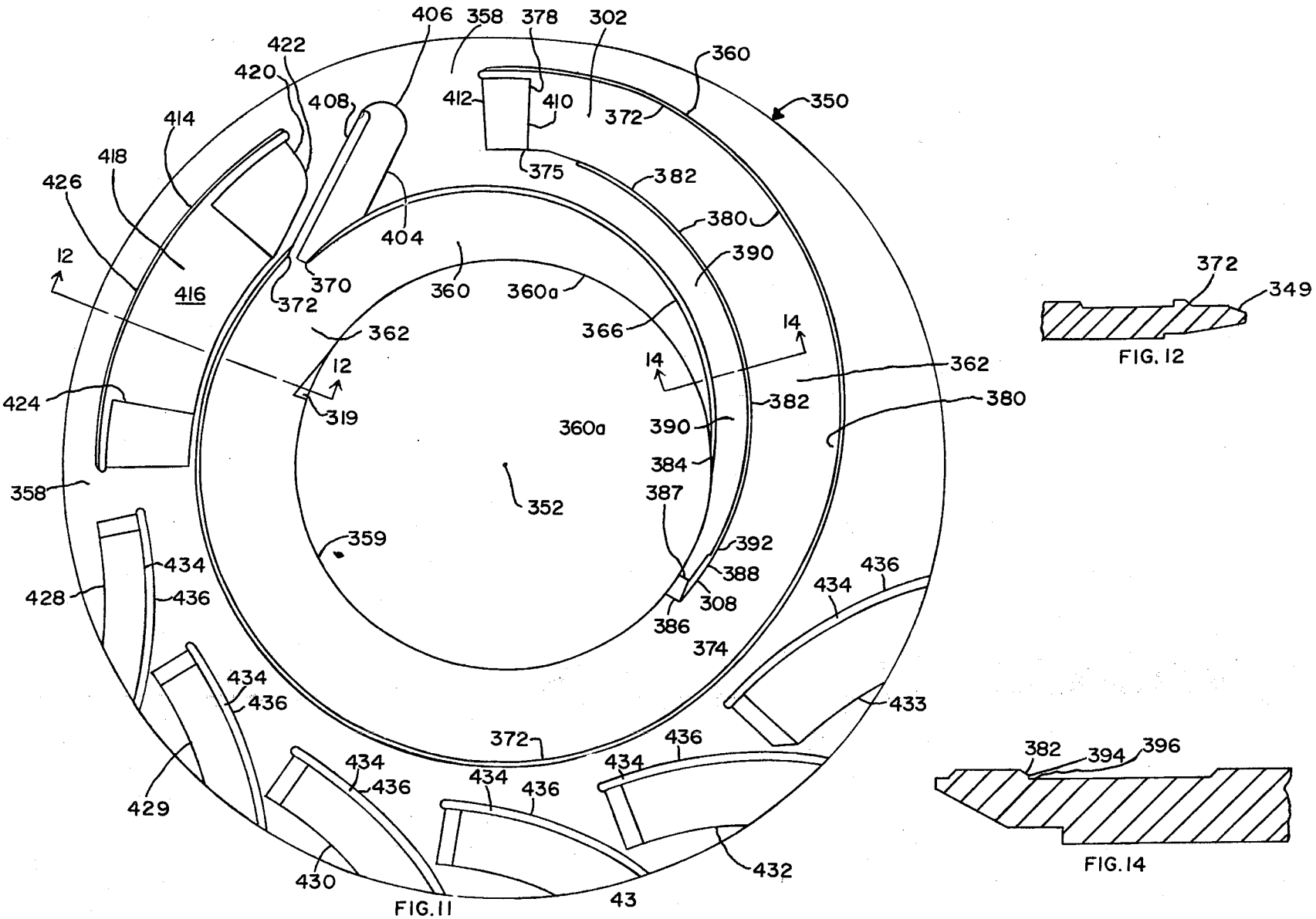
FIG. 11 is a plan view of the underside of a modified form of guide plate.
FIG. 12 is a sectional view taken along line 12—12 of FIG. 11.
FIG. 14 is a sectional view taken along line 14—14 of FIG. 11.
Figure 13:
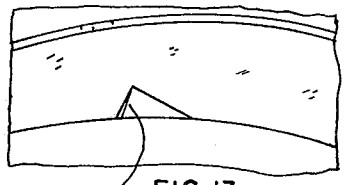
FIG. 13 is a fragmentary pictorial view of a portion of the guide plate shown in FIG. 11, particularly illustrating the configuration of a notch employed to separate shingled coins.

As one feature of the invention, guide plate 350 provides means of preventing shingling of coins, that is, means for preventing the condition in which one coin rides over another, a condition which typically occurs at edge 359 (FIGS. 11 and 16).

Referring to FIG. 16, there are illustrated shingled coins C1 and C2, wherein coin C1 is riding partially on top of coin C2. With disc 10 moving in the direction of the arrow, the top coin, C1, is engaged by notch 349, temporarily stopping it and allowing coin C2 to be rotated free, and thus the two coins separated.

Figure 19:
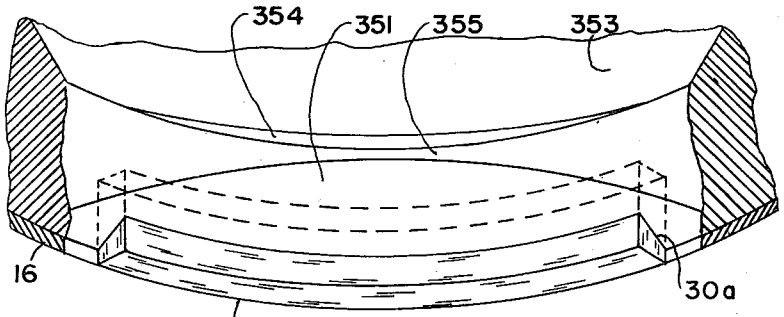
FIG. 19 is a fragmentary view of an inside, front, portion of a hopper, illustrating the inclusion of a resilient anti-shingling.

An alternate means of preventing shingling is illustrated by the addition to hopper 30 of an arcuate slot 30*a* (FIG. 18) into which, as shown in FIG. 19, there is inserted a resilient member 30*b*, it extending downward to a plane coinciding with the plane of the adjacent underside of guide plate 350. Resilient member 30*b* is an elastomer, such as neoprene, and provides significant friction to a coin when pressed into its surface. In operation, when the top coin of two coins which are shingled presses upward against member 30*b*, there is a frictional effect on it which applies a drag, slowing its movement, and thus allowing the lower of the coins to be rotated on pad 27 (FIG. 22) from under it.

Referring now to FIG. 11, and keeping in mind that this figure shows a bottom view of guide plate 350, guide plate 350 has a flat, rigid, lower surface 358, positioned closely adjacent to the surface of pad 27, as shown in FIG. 22. There is a generally spiral-shaped recess 360 in lower surface 358, and this recess, extending approximately 0.065 inch above lower surface 358, commences at a point 368 at the edge 359 of central opening 358. The recess is bordered by a tapered (45°) edge 366 and generally widens in an outward spiral, which extends angularly (counterclockwise as viewed) about center point 352 for approximately 120° to point 370. From point 370, recess 360 with tapered (45° ) guide edge 372 as an outer edge, is essentially of a constant width of approximately 1-5/16 inches around plate 350 for approximately 180° to point 374. From point 374, recess 360 extends in an outward spiral for approximately 130° to point 375 adjacent to down ramp 378. The latter spiralled portion of recess 360 is of a width just sufficient to accommodate the diameter of a single coin of the largest diameter of coin to be accommodated, e.g., 1.215 inches for a U.S. 50-cent piece, which has a diameter of 1.205 inches, and this portion of recess 360 is particularly referred to as single file track 380.

Recess 360 forms a single file track for coins. Its inner side 382 and outer edge 366 are formed on opposite side walls 383 and 385 of protrusion 384, which has at its bottom surface 390 a region of lower plate surface 358. Protrusion 384 extends counterclockwise from point 386 in an outward spiral, with its outer edge terminating near ramp 378, and its inner edge merging into recess surface 362.

Protrusion 384 has a front tapered region 388 (tapered to fall 0.065 inch in 5/16 inch)(from point 386 to point 387) at the entrance of single file track 380, which functions to smoothly and completely radially capture coins which do not freely pass on either side of it. To facilitate radial capture of coins which have entered track 380 but have stopped radially short of guide edge 372, the front outer edge region 388 of protrusion 384 is tapered from point 386 to point 392 at an angle of 45° from recess surface 362 to lower plate surface 390 of protrusion 384. This tapered edge region 388 functions to smoothly capture coins rotated at a fixed radial position into it.

Continuing counterclockwise along wall 382, and as shown in FIG. 14, wall 382 has a lower portion 394 (keeping in mind the inverted position of FIGS. 11 and 14), which is tapered at 45° and an upper portion 396 which is vertical. This combination enables the bottom coin C4 (FIG. 16) of two stacked coins C3 and C4, which are layered or shingled as shown, to be captured by protrusion 384 and then rotated (in the direction of the arrow) at the radial position of capture until the lower of the coins is freed inboard of protrusion 384.

Figure 15:
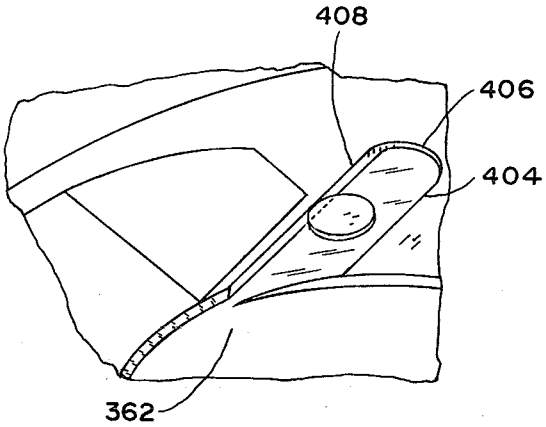
FIG. 15 is a fragmentary pictorial view of a portion of the guide plate shown in FIG. 11, illustrating a slot which functions to accept coins which are not properly aligned for sorting.

While it is the object of the structure thus far described to assure that coins passing through track 380 will arrive at ramp 378 in single file and will be positioned with their outer edge against guide edge 372, it is possible that a coin will rest edgewise on a coin which is against guide edge 372 and thus will not be so positioned. In order to take care of this contingency, and to assure sorting in accordance with the operation to be described, a slot 404 (FIGS. 11 and 15) is provided, which has its outer edge 406 radially interior, by approximately 3/16 inch (measured laterally from the bottom of guide edge 372). This slot, with vertical edge 408, extends inward at an angle of approximately 25° (with respect to a radial line intercepting it) to merge with recess surface 362, as illustrated in FIG. 15. Since outer edge 406 of slot 404 is radially inboard of guide edge 372, slot 404 will let pass and not catch coins which are radially aligned against guide edge 372 at the time they transit ramp 378. On the other hand, vertical edge 408 will catch coins which are significantly inboard of this radial position and cause them to pass along slot 404 inboard and be rerotated along track 380 to ramp 378.

A 45° taper on edge 366 from point 364 to 370 and guide edge 372 tends to apply a downward force on coins striking these edges, which force is met by a flexible and resilient pad 27 (FIG. 16). As a result, there is provided a gradually increasing breaking force which tends to ease the impact from coins and to reduce coin bounce.

As will be appreciated from the above description and discussion, coins do not always make it to a position in single file along guide edge 372 by their initial outward radial movement. A significant number fall short, and these must be returned to the center region of pad 27 for another try. A problem in effecting this turn around is to accomplish it without jamming and without such severe impact on coins as to effect significant wear on them. In the case of the embodiment of the invention now under discussion, most coins being returned to the center of pad 27 are returned by radial capture accomplished by protrusion 384. Since capture is effected at tapered surfaces of protrusion 384 and by a gradual depression of coins into the surface of pad 27, there is a relatively soft impact between coins and protrusion 384 which contributes little wear.

When coins do reach a position with their outer edge precisely against guide edge 372 and are rotated through track 380 in this posture, they are next rotated under ramp 378, and thus radially captured by lower surface 358 at their then radial position. Ramp 378 tapers downward from recess 362, from line 410 to lower surface 358 at line 412. As shown, ramp 378 is spaced approximately 0.125 inch from tapered edge 372 for ease of manufacture.

Coins exiting ramp 378 are rotated, as captured, to gauge slot 414. Gauge slot 414 functions to finally position coins before sorting. It is generally of arcuate shape and in central region 416 (FIGS. 12 and 14) and; has an upper or top recessed surface 418 which is 0.100 inch above (or recessed in) guide surface 358. Ascending ramp 420 at entrance side 422 of gauge slot 414 makes a gradual transition between the surfaces. Similarly, descending ramp 424 at exit side 425 provides a gradual decline from the top surface of gauge slot 414 to guide plate lower surface 358. Gauge edge 426 of gauge slot 414 is tapered for the same reasons as edge 366 and guide edge 372, in order to prevent bounce; but on the other hand, it is particularly important that coins come to rest at the same precise radial position in slot 414, and thus there is a lesser taper, approximately 17° (measured inward from a plane normal to lower surface 358) for gauge edge 426, whereby coin thickness will have less effect on radial positions, thus enabling more precise gauging. Slot 414 rises approximately 0.1 inch above lower surface 358, and thus coins in this slot are quite free of its top surface 418 and readily and freely move on pad 27 to a precise position against gauge edge 426. In order to assure proper operation, the radial position of gauge edge 426 is slightly outboard of gauge 372 (approximately 0.125 inch). This permits some radial slippage of coins as they are rotated between guide edge 372 and slot 414 without their moving radially outward beyond gauge slot 414, which would prevent them from being rotated into and being aligned by gauge slot 414. Entrance ramp 420 and exit ramp 424 of gauge slot 414 are both inboard of gauge edge 426 by approximately 0.125 inch for ease of manufacture. Coins are rotated from gauge slot 414 by pad 27 (FIG. 16) and are radially captured as they pass down ramp 424 and make full engagement with lower surface 358 of guide plate 350. Coin release slots 428, 429, 430, 431, 432, and 433 are positioned in this order in an arcuate pattern following ramp 424, and thus are positioned to intercept coins in generally the same fashion as described above with respect to embodiments of the invention illustrated in FIGS. 2 and 5. Thus, slot 428 is radially positioned to intercept the smallest diameter of coin to be sorted, and coin release slot 433 is radially positioned to intercept the largest of coins to be sorted. Each slot is of a height and radial width to accommodate a selected coin.

It is to be noted that the coin release slots of this embodiment of the invention have been modified in two respects. First, each of the slots has a narrow milled groove 434 along an inner guide edge 436, and it extends slightly to the front or entrance of the slot. This groove rises about 0.02 inch above the general surface 438 of each slot and is one means of insuring that the inner edge of each slot is precisely vertical and cut clean up to at least the level of surface 438, which is important for the precise release of coins. Second, the slots are curved outward in a reverse curvature to that of the periphery of guide plate 350. The entrance edge of each slot commences at the approximate intersection with a radial line extending from center point 352 of disc 10 to the inner edge of each slot, and the slot continues circularly about a radius of approximately six inches, for a 13-inch disc, which radius has a center (not shown) lying on the reference radial line. Because the direction of each slot extends outboard of the tangential direction of movement of coins on pad 27, coins, such as coins 441 and 443, are caused to move through appropriate coin release slots in biased engagement with inner edges 436 of the slots. This causes coins to exit slots along a straight line, as illustrated by coins 441*a* and 443*a* in FIG. 16. Straight line exiting facilitates the detection (for counting) and capture of coins from discrete exits in separate containers. While straight line exiting of coins from each slot may be achieved by straight slots as shown in FIG. 3, curved coin slots require less angular space about the sorter, enabling a greater number of slots to be accommodated and thus the sorting of a greater variety of different diameter coins for a given diameter sorter.

Discrete counters 450, e.g., of photoelectric or proximity types, are positioned adjacent the exit paths of each coin to count exiting coins.

In operation, coins deposited through hopper 30 (FIG. 22) on pad 27 are moved outward by centrifugal force (FIG. 16). Normally there is a continuous flow of coins onto guide edge 372 where the coins are formed in a single layer and single file. At this point, coins are radially restrained and are caused to follow the spiral path provided by track 380, which causes the coins to be directed to ramp 378. Assuming that all of the coins are in line, they will pass down ramp 378 and pass return slot 404 and be fed to gauge slot 414 where, after final radial alignment therein, they are fed onto coin release slots 428–433 for release as previously described. They are then counted by counters 450.

Coins which come to a halt radially short of guide edge 372 but at least radially in line with protrusion 390 are captured by protrusion 384 and rerotated, enabling them to normally move to a position along guide edge 372. Where there is a coin such as coin 440 (FIG. 15) which is within track 380 but not properly in an in-line position, this coin is captured by slot 404 and moved inboard for rerotation.

Thus, by one of the means provided, all coins are directed onto guide edge 372 and then through track 380 for sorting without encountering obstructions which are likely to trap coins in the sorter or jam the mechanism of the sorter. Coins are moved at adequate but not excessive velocities, and when their movement in one direction is halted or their direction is changed, it is generally accomplished with a minimum impact on coins.

Accordingly, it is believed clear that the present invention (1) provides a significantly faster coin sorter, (2) provides a basically jam-proof and fool-proof sorter, and (3) provides a sorter which produces little wear on coins.

We claim:

1. A coin sorter for sorting different denominations of coins comprising:

a rotatable member having a resilient surface;

an annular-shaped stationary member having a surface substantially parallel with said resilient surface and positioned sufficiently close to said resilient surface so that a portion of the stationary surface presses coins in contact therewith into the opposed resilient rotatable surface so that the resiliency of the rotatable surface urges the coins against the stationary surface with sufficient pressure to prevent radial movement of coins by centrifugal force due to rotation of the rotatable member, while permitting circumferential movement of the coins by rotation of the rotatable member;

selected area of the surface of said stationary member being recessed for releasing any coins entering such recessed areas from the pressure of said resilient surface and thereby permitting radial movement of coins within the recessed areas by centrifugal force due to rotation of the rotatable member, said recessed areas being shaped to first guide coins outward in single file along a predetermined path, and second, to permit coins of different sizes to escape radially from between said surfaces by centrifugal force at different preselected positions along the periphery of said stationary member;

said recessed areas which permit coins of different sizes to escape radially being curved along an arc which intersects the direction of rotation of said rotatable member.

2. A coin sorter as set forth in claim 1 wherein said stationary member includes guide means, in turn including an inner facing guide edge of a recessed area, which guide edge extends outwardly in a spiral to a selected radial position for horizontally positioning coins on said rotatable member in a single file, with the outer edges of the coins at said selected radial position, and thereby their inner edges are positioned at a discrete radial position dependent upon the diameter of a coin.

3. A coin sorter as set forth in claim 2 wherein said inner facing guide edge is beveled outwardly at its lower extremity.

4. A coin sorter as set forth in claim 1 which includes a hopper positioned centrally over said rotatable member and having a generally circular interior with tapers inwardly and downwardly.

5. A coin sorter as set forth in claim 4 wherein said hopper comprises:

a generally circular exit opening extending downwardly from said tapered region, which is eccentric with respect to the generally circular interior; and a lower face on said hopper being downwardly and outwardly tapered about a generally circular axis, which is generally concentric with said rotatable member;

whereby coins tending to stand on an edge adjacent an inner edge of said stationary member are rotated under said lower face and are thereby tipped inward to a normal slant position.

6. A coin sorter as set forth in claim 1 comprising coin separating means positioned adjacent the inner edge of said annular-shaped stationary member for applying a retarding force to the upper of a pair of shingled coins being rotated on said top surface of said rotatable member, whereby the coins are separated.

7. A coin sorter as set forth in claim 6 wherein said coin separating means comprises a notch in the upper surface of said stationary member, and said notch having a face generally normal to the direction of rotation of coins on said rotatable member, whereby the upper of two shingled coins would be caught by said notch, and the lower of the coins rotated by said rotatable member free of the upper coin.

8. A coin handling device comprising:

a horizontally positioned circular coin carrying disc having a resilient upper surface;

an annular horizontal guide plate concentrically positioned above said rotating disc and generally having a flat surface over said disc at a selected hight, said height being such as to clear the thickest coin to be handled;

at least one horizontal, stationary, peripheral limit guide extending downward to proximately the resilient surface of said disc and horizontally extending only part way around an outer region of said disc, and having a tapered inner edge to effect a wedging action on coins against said flexible surface of said disc;

at least one horizontal, stationary, generally arcuate, inner guide above said disc and extending down to approximately the surface of said disc and having a radius smaller than that of said peripheral limit guide and being circumferentially spaced from the peripheral limit guide;

at least one stationary exit guide above said disc and extending downward at a taper to approximately the surface of said disc, said direction of extension being measured with respect to the direction of rotation of said disc, and said exit guide being located just beyond, measured along the direction of rotation of said disc, said inner guide; and counting means operatively positioned with respect to said exit for counting coins exiting from said disc;

whereby a coin striking the tapered region of said exit guide is gradually pressed down into the resilient surface of said disc and held at a corresponding radial position and then rotated beyond engagement by said exit guide, and a coin passing radially outward of said exit guide is free to be hurled by centrifugal force from said disc to an exit at an end of said peripheral limit guide and thereby to be counted.

9. A coin sorter for sorting different denominations of coins comprising:

a rotatable member having a resilient surface;

a stationary member having a surface substantially parallel with said resilient surface and positioned sufficiently close to said resilient surface so that a portion of the stationary surface presses coins in contact therewith into the opposed resilient rotatable surface so that the resiliency of the rotatable surface urges the coins against the stationary surface with sufficient pressure to prevent radial movement of coins by centrifugal force due to rotation of the rotatable member, while permitting circumferential movement of the coins by rotation of the rotatable member;

selected areas of the surface of said stationary member being recessed for releasing any coins entering such recessed areas from the pressure of said resilient surface and thereby permitting radial movement of coins within the recessed areas by centrifugal force due to rotation of the rotatable member, said recessed areas being shaped to first guide coins outward in single file to a selected radial position, and second, to permit coins of different sizes to escape radially from between said surfaces by centrifugal force at different preselected positions along the periphery of said stationary member; and a gauging recessed area on the upstream side of the first of said recessed areas which permit coins to escape radially from between said surfaces, said gauge recess having an arcuate outer wall which is radially outboard of said selected radial position for referencing the radially outer edges of coins approaching said escape areas.

10. A coin sorter for sorting different denominations of coins comprising:

a rotatable member having a resilient surface;

an annular stationary member having a surface substantially parallel with said resilient surface and positioned sufficiently close to said resilient surface so that a portion of the stationary surface presses coins in contact therewith into the opposed resilient rotatable surface so that the resiliency of the rotatable surface urges the coins against the stationary surface with sufficient pressure to prevent radial movement of coins by centrifugal force due to rotation of the rotatable member, while permitting circumferential movement of the coins by rotation of the rotatable member;

selected areas of the surface of said stationary member being recessed for releasing any coins entering such recessed areas from the pressure of said resilient surface and thereby permitting radial movement of coins within the recessed areas by centrifugal force due to rotation of the rotatable member, said recessed areas being shaped to first guide coins outward in single file along a predetermined path, and second, to permit coins of different sizes to escape radially from between said surfaces by centrifugal force at different preselected positions along the periphery of said stationary member; and coin separating means positioned adjacent the inner edge of said annular stationary member for applying a retarding force to the upper of a pair of shingled coins being rotated on the resilient surface of said rotatable member, whereby the shingled coins are separated.

* * * * *

Disclaimer 4,444,212.—*Victor G. Ristvedt* and *Roy B. Johnson*, both of Manchester, Tenn. COIN HANDLING MACHINE. Patent dated Apr. 24, 1984. Disclaimer filed Mar. 13, 1989 by the assignee, Ristvedt-Johnson, Inc.

Hereby enters this disclaimer to claims 1 through 7 and 9 of said patent.

[*Official Gazette May 9, 1989* ]